US005195691A

United States Patent [19]

Pfeiffer et al.

[11] Patent Number: 5,195,691

[45] Date of Patent: Mar. 23, 1993

[54] TAPE WINDER

[75] Inventors: Horst Pfeiffer, Aldingen; Heinz W. Feinmechaniker, Trossingen, both of Fed. Rep. of Germany

[73] Assignee: Hengstler GmbH, Aldingen, Fed. Rep. of Germany

[21] Appl. No.: 711,457

[22] Filed: Jun. 6, 1991

[30] Foreign Application Priority Data

Jun. 7, 1990 [DE] Fed. Rep. of Germany ... 9006401[U]

[51] Int. Cl.[5] ..... B65H 18/10; B65H 19/22

[52] U.S. Cl. ..... 242/67.1 R; 242/68

[58] Field of Search ..... 242/67.1 R, 67.2, 67.3 R, 242/68, 60, 81, 41, 47

[56] References Cited

U.S. PATENT DOCUMENTS

| | | | |
|---|---|---|---|
| 766,098 | 7/1904 | Brown | 242/60 |
| 1,271,736 | 7/1918 | Loewenstine | 242/67.3 R |
| 1,309,393 | 7/1919 | Carter | 242/67.3 R |
| 1,419,826 | 6/1922 | Di Como | 242/67.3 R |
| 1,597,679 | 8/1926 | Forte | 242/67.3 R |
| 3,371,883 | 3/1968 | Hoffman et al. | 242/67.3 R |
| 3,704,839 | 12/1972 | Manoogian | 242/81 X |
| 3,857,527 | 12/1974 | Kranz | 242/67.3 R X |
| 4,346,954 | 8/1982 | Markus et al. | 242/67.1 R |
| 4,469,287 | 9/1984 | Pfister et al. | 242/67.3 R |
| 4,732,345 | 3/1988 | Golden | 242/67.1 R |

*Primary Examiner*—Stanley N. Gilreath
*Attorney, Agent, or Firm*—Dvorak & Traub

[57] ABSTRACT

This invention relates to a tape winder for winding paper tapes, such as are particularly used as printed paper tapes in tape printer for documentation purposes, which tape winder comprises a driven reel hub, feeding and deflecting rollers and a tape tensioner arm. The reel hub is forklike and is laterally extractable to a limited extent and comprises preferably four winding rods, which are spaced 90° apart so that the tape coil can freely be removed from the winder when the reel has been extracted.

8 Claims, 3 Drawing Sheets

TAPE WINDER

BACKGROUND OF THE INVENTION

1. Field of the Invention

This invention relates to a tape winder for winding paper tapes, such as are particularly used as printed paper tapes in tape printers for documentation purposes.

2. Description of the Prior Art

Such tape winders usually comprise a driven reel hub, feeding and deflecting rollers and a tape tensioner arm and have the disadvantage that the reel hub can be laterally extracted entirely and can easily be lost. Besides, the threading of the leading end of the tape is often difficult and the reel can be wound only to a low density because the tape is not properly guided.

SUMMARY OF THE INVENTION

It is an object of the invention to avoid said disadvantages and to provide a tape winder which comprises a captive reel hub and permits of a simple threading and of the tape into the reelhub can tightly wind the tape to provide a tape coil which can be stored in a small space.

To accomplish that object a tape winder, particularly for winding printed paper tapes in tape printers for documentation purposes, which winder comprises a driven reel hub, two rollers for guiding and deflecting the tape and a tape tensioner arm, is characterized in accordance with the invention by the provision of a forklike reel hub, which is laterally extractable to a limited extent and comprises preferably four winding rods, which are spaced 90° apart so that the tape coil can freely be removed from winder when the reel hub has been extracted. This will facilitate the threading of the leading end of the tape into the reel hub because the leading tape end can simply be introduced between two winding rods and the first convolutions of the tape coil can be formed in that the reel hub is rotated by hand.

The forklike reel hub comprising the winding rods may slidably be mounted in bores formed in the hubs of drive wheels provided at opposite ends of the reel hub and the extracting of the reel hub may be limited by beveled grooves defined by a stop edge and a circlip adapted to enter said grooves so that a loss of the reel hub will be limited.

DETAILED DESCRIPTION OF THE PREFERRED EMBODIMENT

Figure 1:
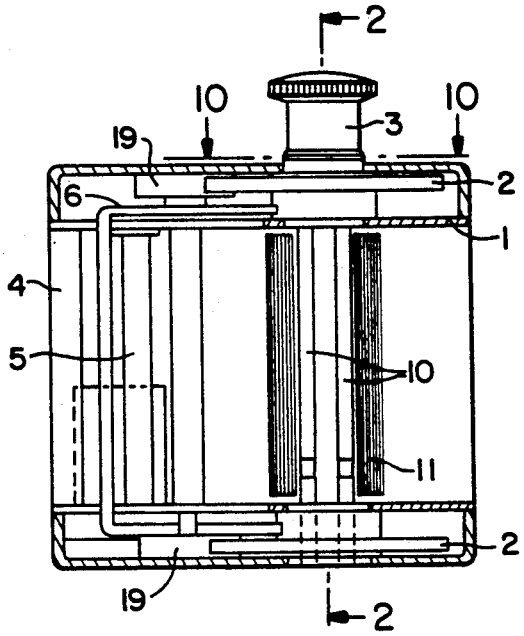
FIG. 1 is a top plan view showing a tape winder, which is cut open.
Figure 2:
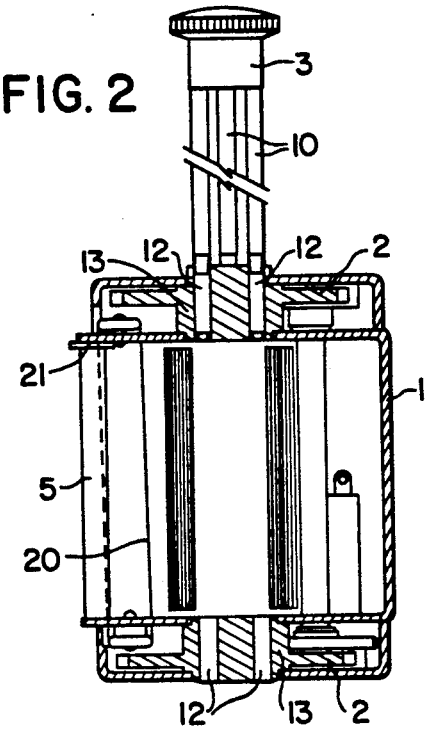
FIG. 2 is a front elevation showing that tape winder, also cut open in a view, on line 2—2 of FIG. 1, with the reel hub extracted.
Figure 3:
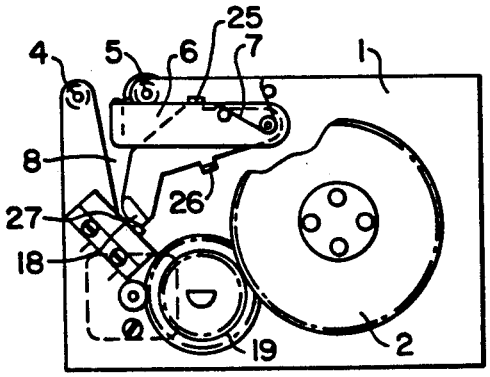
FIG. 3 is a side elevation view of FIG. 1 with a portion of the housing removed.
Figure 4:
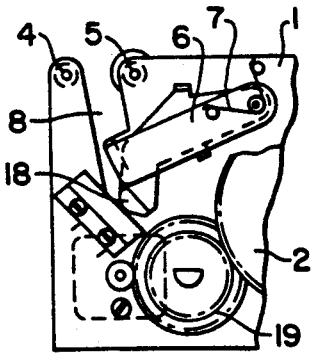
FIG. 4 is partial side elevation view of FIG. 1 with a portion of the housing removed.

An illustrative embodiment of the invention will now be described more in detail with reference to the drawing.

As is apparent from the drawing the tape winder comprises a frame of housing 1, in which enclosed drive wheels 2 are rotatably mounted on both sides. Said wheels 2 serve to drive the extractable forklike reel hub 3. Two guiding and deflecting rollers 4 and 5 and a tensioner arm 6 are also mounted in the housing. Under the action of the torsion spring 7 the tensioner arm 6 extends through the slot 8 of the housing and between the two rollers 4, 5 to loop and tension the paper tape 9.

Figure 5:
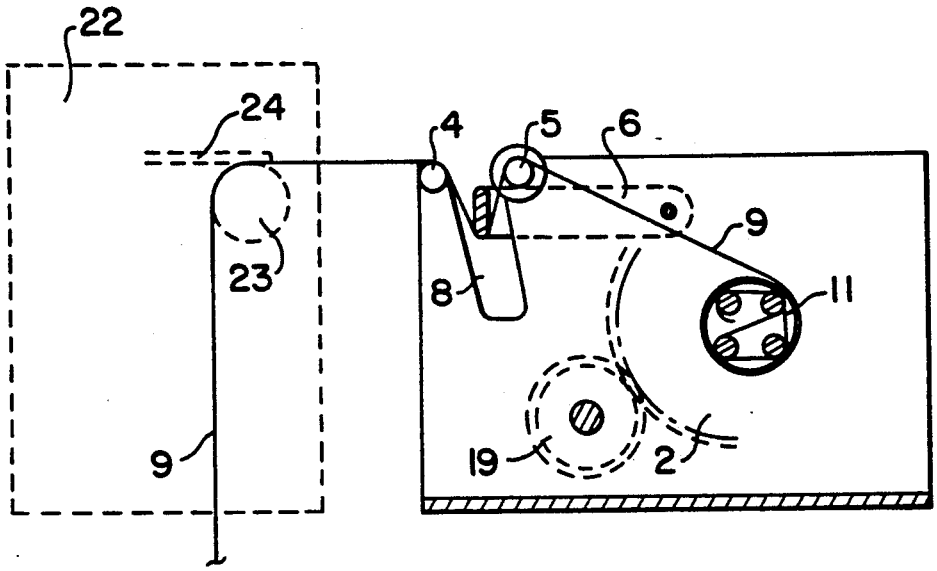
FIGS. 5 and 6 are a schematic side elevations illustrating the winding operation.
Figure 6:
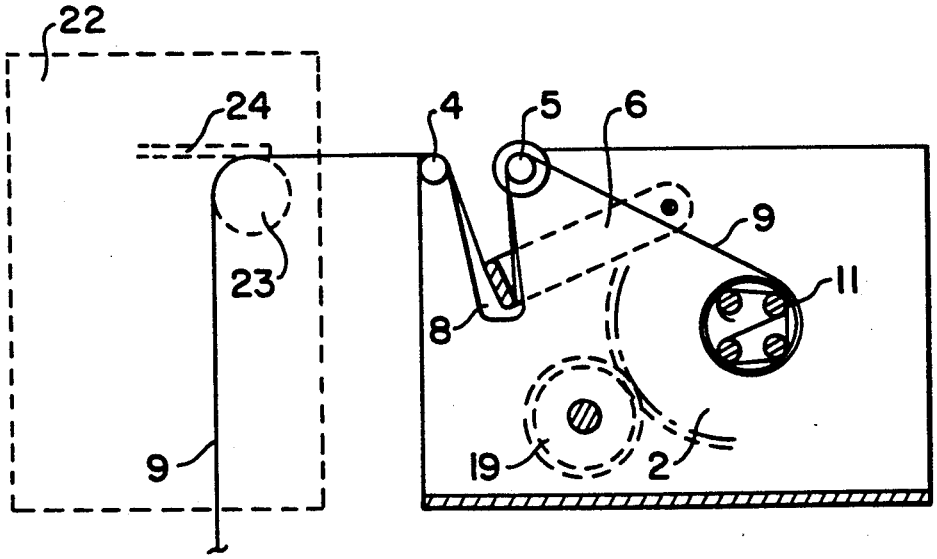
Figure 7:
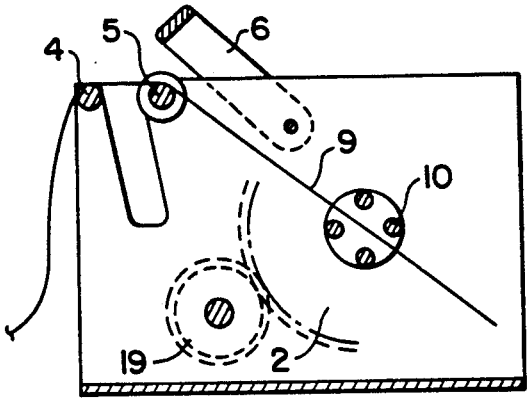
FIGS. 7 and 8 are a schematic elevation illustrating the threading operation.
Figure 8:
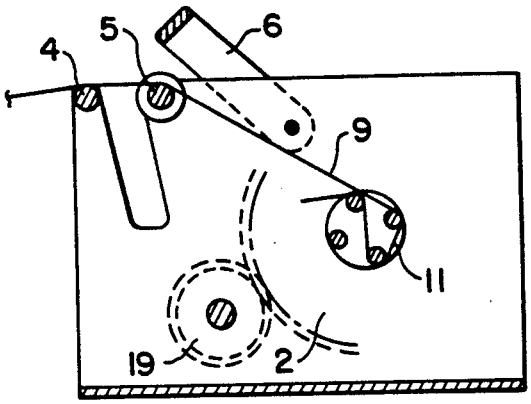
Figure 9:
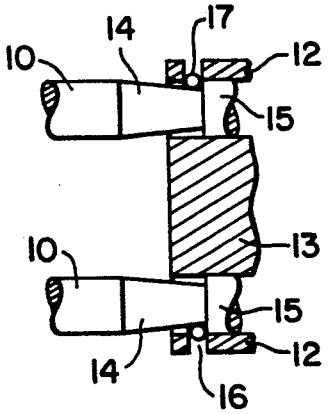
FIG. 9 is a detailed, partial view of the winding rods removed from the winding space as shown in FIG. 2.
Figure 10:
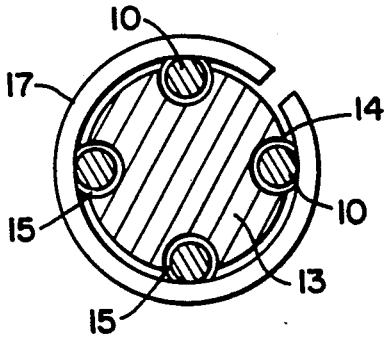
FIG. 10 is a section view taken along the lines 10—10 of FIG. 1.

The extractable forklike reel hub 3 comprises four winding rods 10, which are arranged in a circle and spaced 90° apart. When the tensioner arm 6 has been raised as shown in FIGS. 7 and 8 and the paper tape 9 has been threaded between two adjacent rods 10 the tape reel 11 can be wound up while the tensioner arm 6 serves as a looper, as is shown in FIGS. 5 and 6. The tape coil 11 can then laterally be removed from the frame 1 when the reel hub 3 has laterally been extracted. The winding rods 10 are slidably mounted in bores 12 formed in the hubs 13 of the drive wheels 2, which are provided at opposite ends of the reel hub 3 and serve to drive the latter. The extraction of the reel hub 3 is limited by grooves 14, which are formed on the rods 10 near one end thereof and defined by a stop edge 15 for cooperating with the spring ring 17, which extends inwardly open, annular in the open slot 16, formed in the wheel hub 13 as is apparent from FIGS. 9 and 10. The bottom of each groove 14 tapers to the stop 15. Owing to that arrangement the reel hub 3 cannot entirely be extracted and for this reason cannot be lost but can be extracted only to such an extent that the tape coil 11 is released and can freely be removed from the housing 1.

The tape tensioner arm 6 forming a loop in the tape 9 between the rolls 4 and 5 engages tabs 25 and 26 of a pivoting actuator 18. Actuator 18 operates a switch 27 for controlling a motor, not shown, for driving by means of pinions 19 and the gear wheels 2 and the reel hub 3. The strip tensioner arm 6 has a beveled edge face 20, which cooperates with an annular stop 21 of the deflecting roller 5 to ensure a proper feeding of the tape 9 to the reel hub 3 and a tight winding of the tape on the hub 3. Annular stop 21 is disposed about an end of deflecting roller 5 and guides the tape 9 over the roller 5. Tensioner arm 6 maintains the proper tension on tape 7 via beveled edge face 20.

The FIGS. 5 and 6 illustrate by way of example a tape printer 22, which comprises a printing roller 23 and a printing lever 24 for printing the tape 9 before it is wound on the reel hub 3.

We claim:

1. A tape winder of the type comprising a frame defining a winding space, a reel hub rotatably mounted in said frame, drive means disposed on said frame for rotating said reel hub to wind a tape on said reel hub to form a tape coil in said winding space, two laterally spaced apart, deflecting roller means for guiding and deflecting said tape as it is wound on said reel hub, and a tensioner arm means disposed in said frame and movable between said two deflecting roller means for applying tension to said tape, the improvement comprising:

a plurality of winding rods for engaging said tape, said winding rods disposed on said reel hub, said winding rods slidably extendable through said frame, and said winding rods removably disposed in said winding space through said frame;

bore means disposed in said drive means for slidably receiving and engaging said winding rods when said winding rods are slidably extended through said frame and disposed in said winding space, said winding rods driven in rotation by said drive means when said bore means are engaged by said winding rods thereby winding said tape around said winding rods to form said tape coil; and stop means disposed on said drive means for preventing the disengagement of said winding rods from said drive means when said winding rods are removed from said winding space upon slidably extending said winding rods through said frame.

2. The improvement set forth in claim 1, wherein said winding rods are arranged in a circular array of four rods spaced 90 degrees apart.

3. The improvement set forth in claim 1, wherein said drive means comprise two drive wheels, which are rotatably mounted in said frame at opposite ends of said reel hub and comprise axial wheel hubs formed with angularly spaced apart parallel bores, and said winding rods axially slidably disposed in said bores.

4. The improvement set forth in claim 3, wherein each of said winding rods has one end which is a trailing end as said reel hub is extracted from said winding space, and each of said winding rods has an axially inwardly facing stop edge disposed adjacent to said trailing end.

5. The improvement set forth in claim 4, wherein each of said winding rods has axially inwardly of said stop edge a portion which tapers to said stop edge and defines a groove disposed thereon, said wheel hub of one of said drive wheels is formed with an annular slot, which surrounds and radially opens into one of said bores, and said stop means comprising a radially inwardly biased spring ring radially and slidably disposed in said annular slot and arranged to enter said groove and to engage said stop edge for preventing the disengagement of said winding rods from said drive means when said winding rods are removed from said winding space upon slidably extending said winding rods through said frame.

6. The improvement set forth in claim 3, wherein said frame is constituted by a housing, in which each of said drive wheels is substantially enclosed on both sides, said two rollers are rotatably mounted in said housing on one side of said reel hub and said housing defines a slot extending between said two rollers at each end thereof, and said tensioner arm is movable in said slots to and from a position for looping said tape between said rollers.

7. The improvement set forth in claim 1, wherein a switch for controlling said hub drive means is mounted in said frame and provided with a switch actuator and said tensioner arm is biased to an operative position for looping said tape between said rollers and for cooperating with said switch actuator for controlling said hub drive means.

8. The improvement set forth in claim 1, wherein one of said rollers is provided with an annular stop and said tensioner arm has a beveled restraining edge for cooperating with said annular stop.

* * * * *